US005127121A

United States Patent [19]

Bossie

[11] Patent Number: 5,127,121

[45] Date of Patent: Jul. 7, 1992

[54] PAINT CAN OPENER

[76] Inventor: Leland R. Bossie, Rt. 2 Mason Rd., Ranolph, Vt. 05060

[21] Appl. No.: 745,197

[22] Filed: Aug. 15, 1991

[51] Int. Cl.[5] ..... B25D 1/04; B26B 21/14; B26F 1/00

[52] U.S. Cl. ..... 7/143; 30/82; 30/358

[58] Field of Search ..... 30/82, 329, 332, 334, 30/337, 340, 358, 405, 408, 409, 412, 400; 7/143, 152

[56] References Cited

U.S. PATENT DOCUMENTS

| | | | |
|---|---|---|---|
| 908,346 | 12/1908 | Smith | 30/408 |
| 1,252,996 | 1/1918 | Bryant | 30/82 |
| 1,851,697 | 3/1932 | Elliott | 7/143 |
| 2,637,904 | 5/1953 | Springer | 30/334 |
| 4,512,381 | 4/1985 | Alvarez | 30/340 |
| 4,821,418 | 4/1989 | Windhager | 30/329 |
| 4,932,129 | 6/1990 | Schellstede et al. | 30/358 |

FOREIGN PATENT DOCUMENTS

| | | | |
|---|---|---|---|
| 142288 | 5/1920 | United Kingdom | 30/400 |

OTHER PUBLICATIONS

Published article of Robert M. Yoder p. 28 dated Oct. 2, 1948.

*Primary Examiner*—Douglas D. Watts
*Assistant Examiner*—Paul M. Heyrana, Sr.
*Attorney, Agent, or Firm*—Leon Gilden

[57] ABSTRACT

An elongate handle mounts a generally "J" shaped head thereon in a forward end of the handle of the "J" shaped head, including a planar construction defining an inner edge and an outer edge, with the inner edge including a first lug cooperative with the second lug defining a receiving gap therebetween, with the receiving gap intersected by a piercing lug for puncturing of a gutter portion of an associated paint can to permit drainage of paint through a conventional paint can gutter. The organization includes a lifting lug mounted to an outer edge of the "J" shaped head for removal of the associated paint can lid. The handle of the organization further includes an internally threaded bore selectively mounting a hammer head portion or a blade support member to secure a blade therewithin for scraping during a painting procedure.

2 Claims, 4 Drawing Sheets

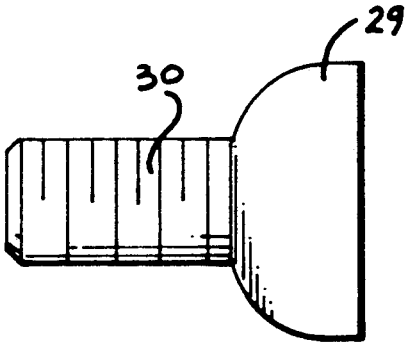
Fig 9
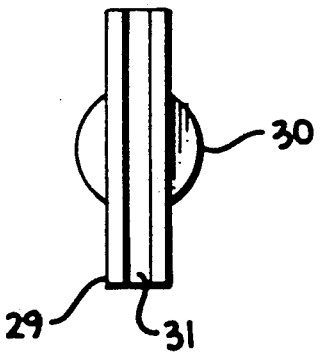
Fig 10
Fig 11
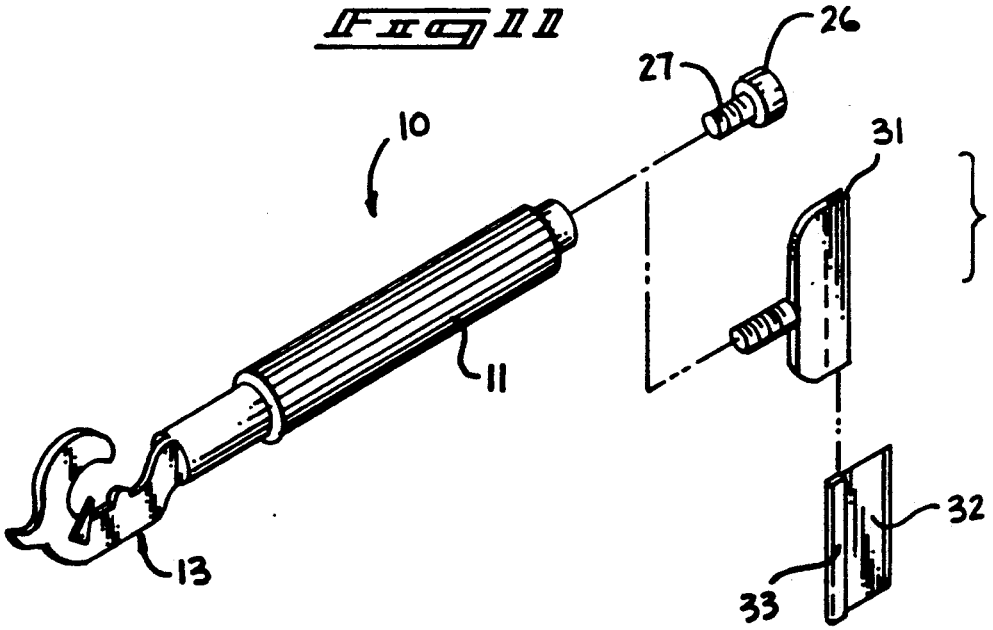

PAINT CAN OPENER

BACKGROUND OF THE INVENTION

1. Field of the Invention

The field of invention relates to can opener structure, and more particularly pertains to a new and improved paint can opener wherein the same is arranged to effect lid removal and selective puncturing of a gutter portion of an associated paint can.

2. Description of the prior Art

The use of paint cans typically requires a plurality of tools to effect a lid opening, with a hammer member required subsequently to effect closure of the lid relative to the paint container. A gutter mounted within the paint container to secure the lid frequently contains paint therewithin during a painting procedure to deposit such paint, wherein tools are available to effect puncturing of the gutter. The instant invention attempts to overcome deficiencies of the prior art by providing an individual tool permitting ease of use and disassembly and reassembly of an associated paint can. Various prior art devices to effect the selective opening of cans and the like are exemplified in U.S. Pat. Nos. 4,941,262; 4,782,594; 4,580,700; and 4,500,015. U.S. Pat. No. 4,864,898 to Tricinella sets forth a combination can and bottle opener employing a plurality of gaps to permit selective opening of a pop-top can or a conventional capped bottle setting forth the use of a multi-purpose tool.

Accordingly, it may be appreciated that there continues to be a need for a new and improved paint can opener as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of can opener apparatus now present in the prior art, the present invention provides a paint can opener wherein the same sets forth a multi-purpose tool to effect the lid lifting, lid replacement, and intermediate gutter puncturing of an associated paint can, with the tool further including implements selectively mounted to a rear terminal end of the tool for use in association in a painting procedure. As such, the general purpose of the present invention, which will be described subsequently in greater detail, is to provide a new and improved paint can opener which has all the advantages of the prior art can opener apparatus and none of the disadvantages.

To attain this, the present invention provides an elongate handle mounting a generally "J" shaped head thereon in a forward end of the handle of the "J" shaped head, including a planar construction defining an inner edge and an outer edge, with the inner edge including a first lug cooperative with the second lug defining a receiving gap therebetween, with the receiving gap intersected by a piercing lug for puncturing of a gutter portion of an associated paint can to permit drainage of paint through a conventional paint can gutter. The organization includes a lifting lug mounted to an outer edge of the "J" shaped head for removal of the associated paint can lid. The handle of the organization further includes an internally threaded bore selectively mounting a hammer head portion or a blade support member to secure a blade therewithin for scraping during a painting procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint can opener which has all the advantages of the prior art can opener apparatus and none of the disadvantages.

It is another object of the present invention to provide a new and improved paint can opener which may be easily and efficiently manufactured and marketed.

It is a further object of the present invention to provide a new and improved paint can opener which is of a durable and reliable construction.

An even further object of the present invention is to provide a new and improved paint can opener which is susceptible of a low cost of manufacture with regard to both materials and labor, and which accordingly is then susceptible of low prices of sale to the consuming public, thereby making such paint can openers economically available to the buying public.

Still yet another object of the present invention is to provide a new and improved paint can opener which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an orthographic side view of a blade support member utilized by the invention.

FIG. 10 is an orthographic top view of the blade support member as illustrated in FIG. 9.

FIG. 11 is an isometric illustration of the tool in association with the various components thereof.

DESCRIPTION OF THE PREFERRED EMBODIMENT

Figure 1:
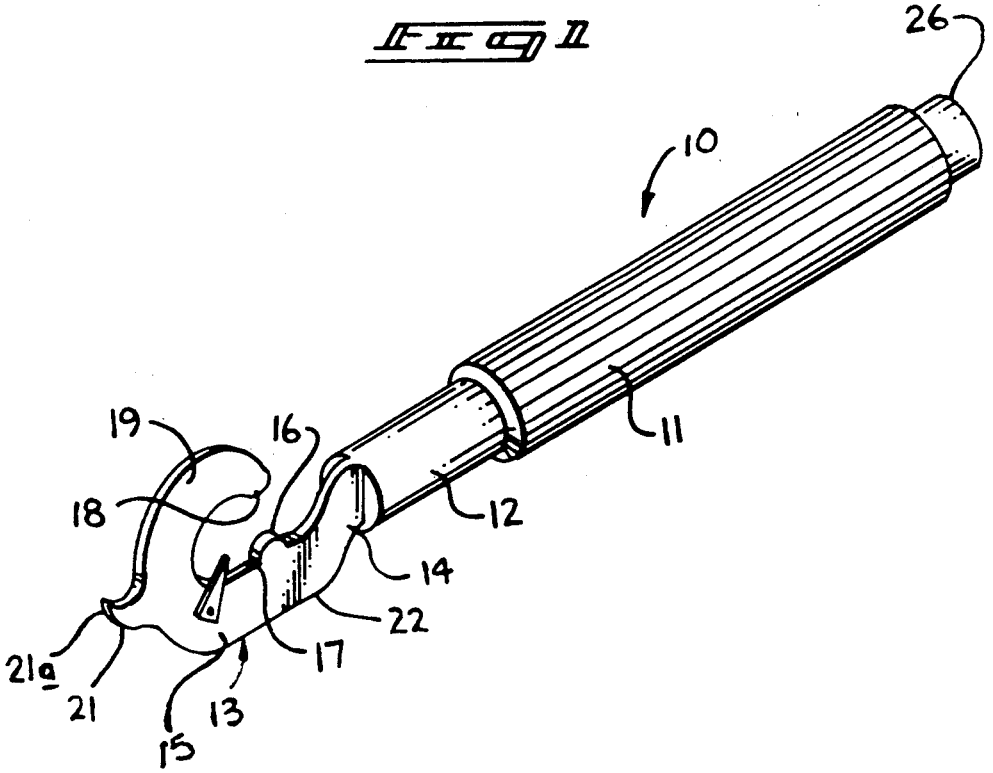
FIG. 1 is an isometric illustration of the instant invention.
Figure 2:
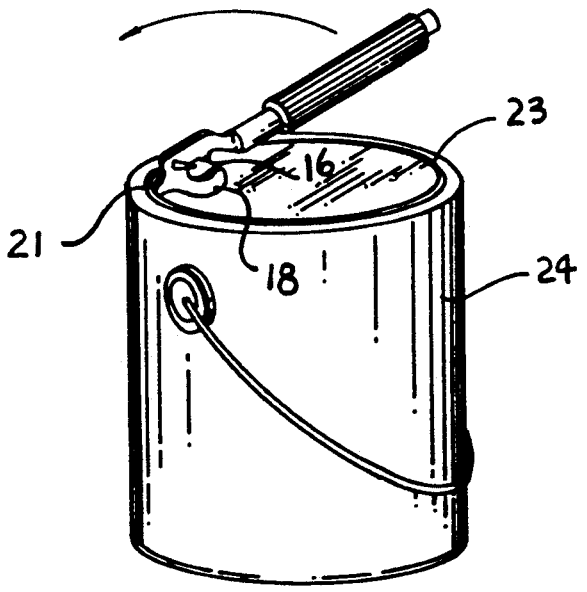
FIG. 2 is an isometric illustration of the tool in removal of a lid from an associated paint container.
Figure 3:
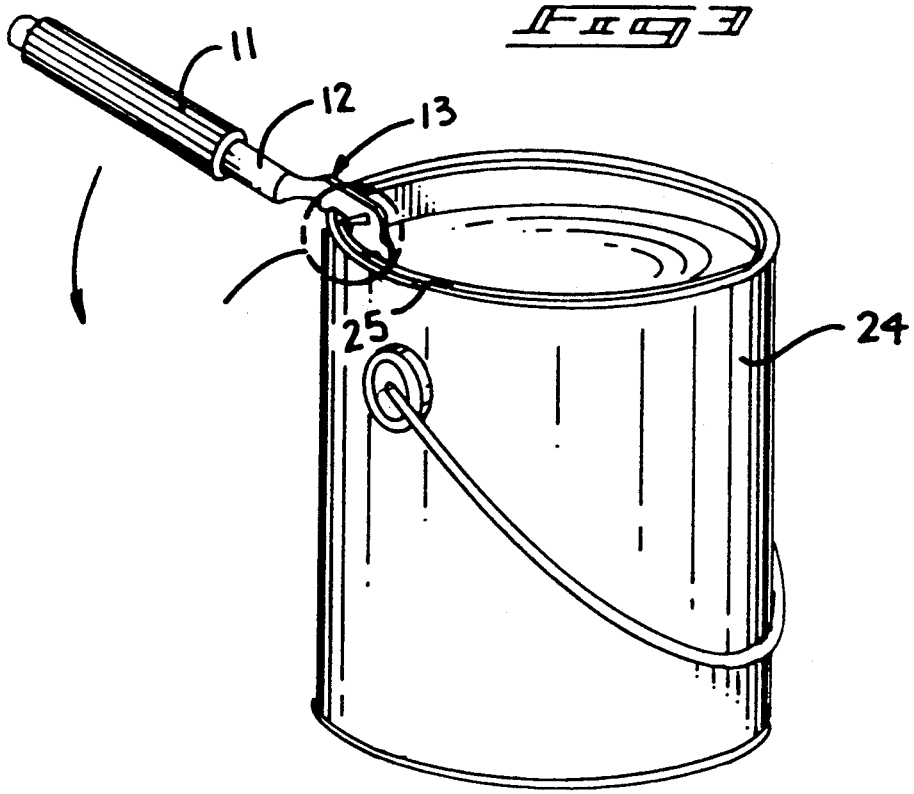
FIG. 3 is an isometric illustration of the tool utilized in puncturing of a paint can gutter.
Figure 4:
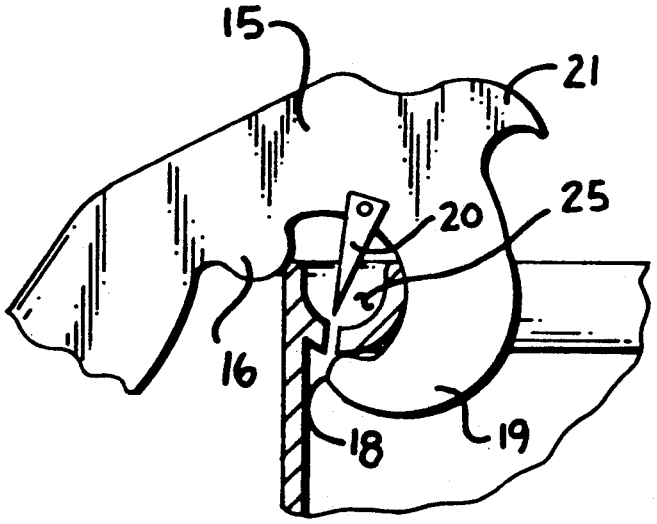
FIG. 4 is an enlarged orthographic view, taken along Section 4, as set forth in FIG. 3.
Figure 5:
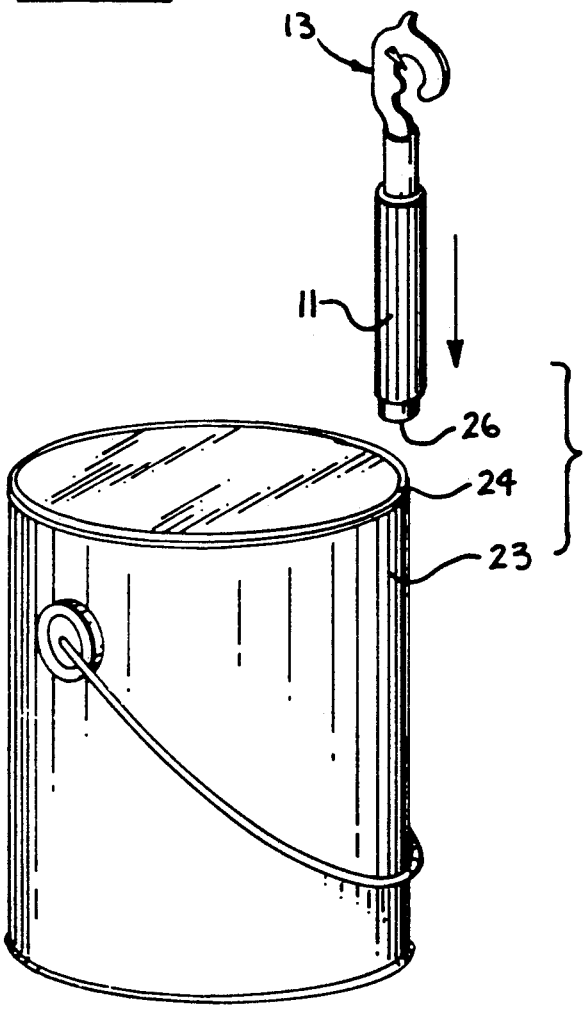
FIG. 5 is an isometric illustration of the invention utilized in the reassembly of the lid relative to the paint container.
Figure 7:
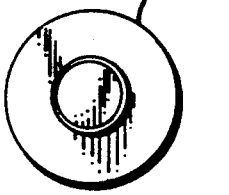
FIG. 7 is an orthographic end view of the hammer portion utilized by the tool structure.
Figure 8:
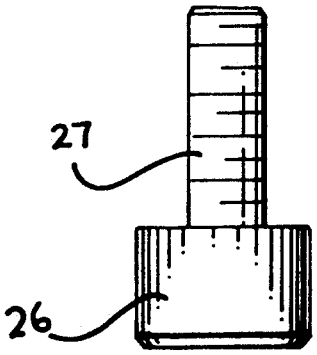
FIG. 8 is an orthographic side view of the hammer portion utilized by the tool.
Figure 6:
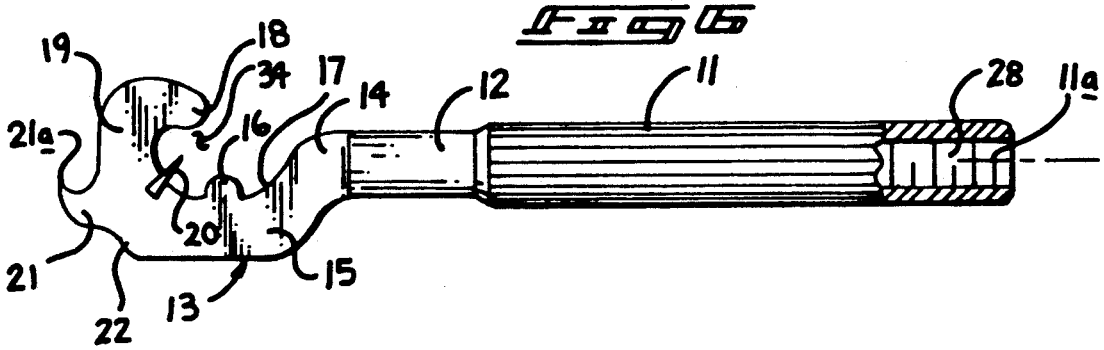
FIG. 6 is an orthographic side view, partially in section of the tool structure.

With reference now to the drawings, and in particular to FIGS. 1 to 11 thereof, a new and improved paint can opener embodying the principles and concepts of the present invention and generally designated by the reference numeral 10 will be described.

More specifically, the paint can opener 10 of the instant invention essentially comprises an elongate aligned handle 11 of a first diameter, including a handle shank 12 extending from a forward end of the handle 11, with the handle shank 12 and the handle 11 coaxially aligned and the handle shank defined by a second diameter less than the first diameter, with a "J" shaped head plate 13 fixedly mounted to the handle shank 12. The "J" shaped head plate 13 is of a planar construction and aligned with an axis 11*a* (see FIG. 6) of the handle 11 and the handle shank 12. It should be further noted that the handle 11 includes elongate parallel ribs formed to the handle 11 to enhance manual engagement of the handle during use. The head plate 13 includes a first plate portion 14 medially bisected by the axis 11*a*, with a second plate portion 15 formed to the first plate portion 14 and offset relative to the first plate portion 14 and the axis 11*a*. The second plate portion 15 includes a third plate portion 19 orthogonally oriented relative to the second plate portion 15 and bisected by the axis 11*a*. An outer rim abutment lug 16 is mounted to the second plate portion 15 along the head plate continuous inner engagement edge 17 defined by the respective first, second, and third head plate portions 19. A continuous outer edge 22 defines an outer edge of the head plate portion, with an inner rim engagement lug 18 formed at a free terminal end of the third plate portion 19 projecting towards the outer rim abutment lug 16 to define a receiving gap 34 therebetween. The receiving gap (see FIGS. 3 and 4) accommodates a paint container lid gutter 25 within the "J" shaped head plate 13 through the receiving gap 34, with the outer rim abutment lug 16 and the inner rim engagement lug 18 securing opposed portions of the gutter, with an aperture piercing lug 20 that is fixedly mounted to the head plate 13 and mounted at an intersection of the second plate 15 and the third plate 19 and projecting between the abutment lug 16 and the engagement lug 18, with the piercing lug 20 oriented towards the receiving gap 34. In rotation of the head 13 about the gutter 25, an aperture is thereby formed utilizing the piercing lug 20 to permit drainage of paint contained within the gutter to drain back into the container 24.

A lid lifting lug 21 is mounted to the continuous outer edge 22 projecting exteriorly of the outer edge and formed to the second plate portion 15, and including a pointed free end 21*a* for projection of the lid lifting lug 21 under an associated paint container lid 23 of the paint container 24 to permit a prying and levering of the lid 23 and a disassembly of the lid relative to the container.

In reassembly of the lid relative to the container, a hammer boss 26 is provided that is mounted to the rear terminal end of the handle 11. The hammer boss 26 includes hammer boss threaded shank 27 threadedly receivable within an internally threaded handle bore 28 formed into the handle 11 from the rear terminal end thereof. The hammer boss 26 is therefore selectively removable therefrom permitting securement of a blade holder plate 29. The blade holder plate 29 includes a blade holder plate threaded shank 30 orthogonally oriented relative to the blade holder plate and its associated groove 31. The groove 31 is arranged to receive a cutter blade spine 33 of an associated cutter blade 32 that is frictionally secured within the groove 31 to permit scraping in a painting procedure in use of the tool structure.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint can opener, comprising, an elongate handle, the elongate handle defined by a first diameter, including parallel ribs coextensive with the handle to enhance manual engagement with the handle, and a handle shank fixedly mounted to a forward end of the handle, with the handle shank defined by a second diameter less than the first diameter, and a "J" shaped head plate, and the elongate handle and the handle shank defined along a single axis, with the "J" shaped head plate of a planar construction receiving the axis therethrough, and the "J" shaped head plate defining a receiving gap to receive a paint container gutter through the receiving gap, and piercing lug mounted to the "J" shaped head plate rearwardly of the receiving gap to effect piercing of the paint container gutter upon pivotment of the "J" shaped head plate about the gutter, and the "J" shaped head plate includes a first plate portion aligned with the axis, and a second plate portion fixedly mounted to and offset relative to the first plate portion, and a third plate portion mounted to the second plate portion spaced from the first plate portion to define a single planar configuration, wherein the third plate portion is orthogonally bisected by the axis, and an inner continuous edge formed interiorly of the "J" shaped head plate, and an outer continuous edge formed to an outer edge of the "J" shaped head plate, and the inner continuous edge includes a first abutment lug mounted to the second plate portion, and the third plate portion includes an engagement lug formed at a free terminal end of the third plate portion, wherein the engagement lug and the abutment lug define the receiving gap therebetween, and the piercing lug is mounted at an intersection defined by the third plate portion and the second plate portion projecting towards the receiving gap, and including a lid lifting lug mounted to the continuous outer edge at the intersection of the second plate portion and the third plate portion, with the lid lifting lug including a pointed free end for rejection underlying the paint container lid for lifting of the lid relative to the paint container, and the rear terminal end of the elongate handle includes an internally threaded bore coaxially aligned with the axis, and a hammer boss, the hammer boss including a hammer boss threaded shank threadedly received within the internally threaded handle bore.

2. A can opener as set forth in claim 1 including a blade holder plate, the blade holder plate including a groove directed therethrough, with the blade holder plate including a blade holder plate threaded shank selectively received within the threaded handle bore, and the blade holder plate groove orthogonally oriented relative to the blade holder plate threaded shank, and a cutter blade including a cutter blade rigid spine frictionally received within the groove, with the cutter blade projecting exteriorly of the groove.

* * * * *